US009073654B2

(12) United States Patent
Rothermel et al.

(10) Patent No.: US 9,073,654 B2
(45) Date of Patent: Jul. 7, 2015

(54) PACKAGING MACHINE AND METHOD OF FORMING A VACUUM PACKAGE

(75) Inventors: Klaus Rothermel, Unteregg (DE); Christian Schoemig, Kettershausen (DE); Herbert Kirmse, Wolfertschwenden (DE)

(73) Assignee: MULTIVAC SEPP HAGGENMUELLER GMBH & CO. KG, Wolfertschwenden (DE)

( * ) Notice: Subject to any disclaimer, the term of this patent is extended or adjusted under 35 U.S.C. 154(b) by 754 days.

(21) Appl. No.: 13/327,876

(22) Filed: Dec. 16, 2011

(65) Prior Publication Data

US 2012/0174531 A1 Jul. 12, 2012

(30) Foreign Application Priority Data

Dec. 21, 2010 (DE) ..... 10 2010 055 438
Sep. 22, 2011 (EP) ..... 11 007 717

(51) Int. Cl.
*B65B 31/02* (2006.01)
*B65B 31/00* (2006.01)
*B65B 31/04* (2006.01)

(52) U.S. Cl.
CPC ..... *B65B 31/024* (2013.01)

(58) Field of Classification Search
CPC ..... B65B 31/02; B65B 31/00; B65B 31/04
USPC ..... 53/432, 434, 512
See application file for complete search history.

(56) References Cited

U.S. PATENT DOCUMENTS 3,832,824 A 9/1974 Burrell
3,965,646 A 6/1976 Hawkins
4,779,398 A * 10/1988 Glandon et al. ..... 53/434

(Continued)

FOREIGN PATENT DOCUMENTS

DE 34 11 917 A1 10/1985
DE 3916170 A1 11/1990

(Continued)

OTHER PUBLICATIONS

German Office Action Dated Sep. 9, 2011, Application No. 10 2010 055 438.3, Applicant MULTIVAC Haggenmueller GmbH & Co. KG.—5 Pages.

(Continued)

*Primary Examiner* — Thanh Truong
*Assistant Examiner* — Praachi M Pathak
(74) *Attorney, Agent, or Firm* — Husch Blackwell LLP

(57) ABSTRACT

The disclosure relates to a packaging machine and to a method of forming a vacuum package. A first evacuable chamber is used for accommodating therein a product-accommodating section of a package, whereas a second evacuable chamber is used for accommodating therein an opening section of the package. Pressure gauges measure the pressure in both chambers, and a supply air valve serves to supply air into the first chamber. The disclosure is characterized in that the supply air valve is a control valve and is adapted to be controlled in dependence upon the difference between the pressures which prevail in the first and second chambers and which are measured by means of the two pressure gauges. The disclosure also relates to the fact that a gap is provided in a partition between the two chambers and that an adjuster is provided for varying and adjusting the cross-sectional area of said gap.

12 Claims, 6 Drawing Sheets

(56) References Cited

U.S. PATENT DOCUMENTS

| | | | | |
|---|---|---|---|---|
| 4,922,686 | A | 5/1990 | Segota | |
| 5,056,292 | A | 10/1991 | Natterer | |
| 8,156,984 | B2 * | 4/2012 | Wieduwilt et al. | 156/378 |
| 2003/0046907 | A1 | 3/2003 | Costello | |
| 2004/0065048 | A1 * | 4/2004 | Kondo et al. | 53/75 |

FOREIGN PATENT DOCUMENTS

| | | | |
|---|---|---|---|
| DE | 10 2004 024 480 | A1 | 12/2005 |
| EP | 0077458 | A1 | 4/1983 |
| EP | 1 564 147 | A1 | 8/2005 |

OTHER PUBLICATIONS

Extended European Search Report Dated Apr. 24, 2012, Applicant Multivac Sepp Haggenmueller GmbH & Co. KG, Application No. 11007717.9-2308, 5 Pages.

* cited by examiner

PACKAGING MACHINE AND METHOD OF FORMING A VACUUM PACKAGE

CROSS-REFERENCE TO RELATED APPLICATIONS

This application claims foreign priority benefits under 35 U.S.C. §119(a)-(d) to German patent application number DE 10 2010 055 438.3, filed Dec. 21, 2010 and EP patent application No. 11 007 717.9, filed Sep. 22, 2011 which are incorporated by reference in their entirety.

TECHNICAL FIELD

The disclosure relates to a packaging machine and to a corresponding method of forming a vacuum package.

BACKGROUND

A packaging machine of the type in question and a method of forming a vacuum package are disclosed by EP 1564147 A1. There, a first and a second evacuable chamber (i.e. a chamber in which a vacuum can be created) are provided. A sealable vacuum bag is introduced in the packaging machine such that a package main section accommodating the packed product is disposed in the first chamber, whereas the opening of the bag is located in a smaller, second chamber. The advantage of this packaging machine is that different vacuums can be created in the two chambers so that the pressure applied to the package from outside is higher than the pressure prevailing in the interior of the package. This higher external pressure stabilizes sensitive products within the package, such as cheese or other porous products, which, if the pressure applied is too low, tend to release bubbles from the porous structures or in which the porous structures tend to burst, whereby the product in question will be damaged. A disadvantage of this conventional packaging machine is that it is comparatively complicated to operate.

Another packaging machine for packaging objects under vacuum is disclosed by DE 3411917 A1. Here, a sealing chamber is divided by the package into a lower chamber and an upper chamber. After creating first a predetermined vacuum, rapid, abrupt venting of the chamber establishes a pressure difference between the inside and the outside space of the package.

SUMMARY

It is the object of the present disclosure to improve a packaging machine and a packaging method for forming a vacuum package with respect to an increased stability of operation and an improvement in the quality of the packaging results.

A first variant of the disclosure is so conceived that the supply air valve is a control valve, which is adapted to be controlled in dependence upon the difference between the pressures in the first and second chambers, which are measured by means of the two pressure gauges, and/or in dependence upon the difference between the pressure prevailing in a chamber and a target final pressure predetermined for this chamber. In the context of the present disclosure, the term "control valve" means that the valve can not only assume a fully open and a fully closed position but also a plurality of intermediate positions at which the control valve is partially open. These intermediate steps can be distributed in the form of discrete opening stages or in a continuous mode between the fully open and the fully closed position. It would also be imaginable that the control valve is continuously adjustable only in a specific range. It differs therefore substantially from the above-cited prior art, where shift valves were used, which could only be adjusted between a fully open and a fully closed position.

Another advantage of the disclosure originates from the fact that the difference of the pressures measured by means of the two pressure gauges in the two chambers is determined and used as an input variable for controlling the supply air valve. The amount of air supplied to the first chamber per unit time therefore depends on this pressure difference. If the pressure difference is small, more air per unit time will be supplied to the first chamber. If the pressure difference is, however, comparatively large, no or at least less air per unit time will be supplied to the first chamber so as to prevent the pressure difference between the two chambers from becoming excessively large. This guarantees that an ideal pressure will always prevail on the outer side of the packages in the first chamber, so that the products will reliably be prevented from being damaged through bursting of porous structures or through bubbles released therefrom. The continuous maintenance of an optimum pressure difference can additionally reduce the processing time during the formation of a vacuum package.

It would be imaginable that the supply air valve is a proportional valve whose opening degree is inversely proportional to the pressure difference in the two chambers. Such a proportional valve allows a continuous adjustment of its opening degree between the fully closed and the fully open position.

The supply air valve may have a linear or a non-linear control curve. In particular a non-linear control curve having a non-linear profile relative to the pressure difference between the two chambers is of advantage. This control curve may e.g., be S-shaped so as to allow the pressure to be controlled as gently as possible.

According to an expedient embodiment, a target final pressure for one or both chambers and/or a target pressure difference between the pressures prevailing in the two chambers is/are adjusted on the packaging machine. The supply air valve can then be controlled through a suitable control unit such that this target pressure difference will be maintained with the least possible variation. According to a still more advantageous solution, the target pressure difference is adjustable, e.g., through suitable operating elements on the packaging machine. The target pressure difference can thus be adapted to different products or to different materials of the package so as to accomplish always the best possible packaging results.

The target pressure difference need not be a single concrete value, but it may preferably be a pressure range. If, for example, the desired pressure difference between the two chambers is 100 mbar, the target pressure difference can be a pressure range between 90 mbar and 110 mbar.

Preferably, the opening degree of the supply air valve is inversely proportional to the extent to which the actual pressure difference between the pressures prevailing in the two chambers deviates from the target pressure difference. When the pressure difference lies within the range defined by the target pressure difference, the supply air valve has a first opening degree. When the pressure difference between the two chambers exceeds the range of the target pressure difference, the supply air valve will open still further, in proportion to the extent to which the actual pressure difference exceeds the target pressure difference. The actual pressure difference can thus return as soon as possible to the range of the target pressure difference.

According to an expedient embodiment, a partition is provided between the two evacuable chambers. This partition offers the advantage that different pressures can prevail in the two chambers.

Preferably, an opening of the supply air valve leading into the first chamber is arranged in a wall of said first chamber located exactly opposite the partition. This mode of arrangement ensures that the air supplied will first act on the package end that is remote from the partition, before it sweeps along the package and flows to the partition. This has the advantage that the residual air still contained in the package will be forced to the opening of the package so that the package can be evacuated more easily and more rapidly.

The partition may have provided therein a gap through which the first chamber and the second chamber are in fluid communication with one another. This gap can have inserted therein part of the package so as to support and stabilize the package relative to the packaging machine. In addition, a minor exchange of air can take place between these two chambers. This has the advantage that an air current flowing along the package can be created, said air current being directed along the package and towards the opening thereof. The package can thus be evacuated more easily. Moreover, the fluid communication between the two chambers allows a variant according to which each chamber is not evacuated separately, but an evacuation opening is provided in only one chamber—preferably in the second chamber, which accommodates the opening of the package. When the second chamber is being evacuated, the first chamber is, by means of the gap, automatically evacuated as well.

When a gap is provided, the opening of the supply air valve leading into the first chamber is preferably arranged on the level of this gap. This additionally supports the formation of an air current along the package, said air current being directed from the package end to the package opening and forcing the residual air still contained in said package to the opening thereof.

According to an advantageous embodiment, an adjuster is provided for varying and adjusting the cross-sectional area of the gap. It is thus possible to adjust the volume flow between the two chambers, i.e., the amount of air exchanged between the two chambers per unit time.

According to the present disclosure, such an adjuster for varying and adjusting the cross-sectional area of the gap in the partition between the two chambers may also be provided independently of the pressure measurement in the two chambers and independently of the implementation of a supply air valve as a control valve. As has already been explained, the adjuster allows an adjustment of the volume flow exchanged between the two chambers. Depending on the nature of the products to be packed and the materials used for the package, this volume flow can be varied so as to achieve an evacuation of the package within the shortest possible time or to the highest possible extent.

Although the adjuster may be operable or adjustable by hand, the packaging machine will be easier to operate when the adjuster is driven by a motor and when the operator inputs, to this end, suitable adjusting commands, e.g., by means of an operator control panel or an operating element. The values adjusted can be stored in a control unit of the machine.

The adjuster may e.g., comprise an adjusting screw, which projects into the gap or which moves a blocking element projecting into the gap.

According to a preferred embodiment, the partition between the two chambers, or at least a part of said partition, is supported such that the cross-sectional area of the gap will not change, not even if one or both chambers are evacuated. This can be achieved in that the partition, or at least a part thereof, is elastically mounted (spring mounted) relative to the base, the lid or a wall of the chambers. Through this, it is avoided that e.g., bending of a lid of the packaging machine under conditions of a substantially reduced internal pressure will lead to a displacement of the partition and, consequently, to a change in the cross-sectional area of the gap, which may either prevent a pressure adaptation between the chambers or lead to an immediate pressure compensation; this would be two equally disadvantageous effects. In particular, the gap may also have provided thereon protrusions or projections, which enter into contact with the opposite side of the gap and prevent the gap from closing to such an extent that a specific minimum opening area would no longer exist.

Another substantial improvement of the packaging machine can additionally be achieved in that a bypass is provided between the two evacuable chambers, said bypass having arranged therein a controllable bypass valve. By means of the opening degree of the bypass valve it can be controlled how much air flows from one of the chambers into the other chamber so as to determine the differential pressure between the two chambers also independently, or at least largely independently of the gap. The controllable bypass valve additionally allows pressure compensation between the two chambers to be adapted to different numbers of bags or to bags having different wall thicknesses, without a change in the gap being absolutely necessary for this purpose. Alternatively, it would, however, also be imaginable to dispense with the provision of a bypass between the two chambers, but to evacuate the smaller chamber at full capacity and the larger chamber at reduced capacity.

The present disclosure additionally relates to a method of forming a vacuum package, comprising the steps of measuring the pressures in a first and in a second evacuable chamber, ascertaining therefrom the actual pressure difference and controlling a controllable supply air valve in dependence upon this actual pressure difference between the pressures prevailing in the two chambers, or in dependence upon the difference between the pressure prevailing in one chamber and a target final pressure predetermined for this chamber.

As has already been described hereinbefore, it will be advantageous when the supply air valve is opened proportionally to a pressure difference and/or when the target pressure difference is predetermined by an operator. The supply air valve can then be opened proportionally (or inversely proportionally) to the extent to which the pressure difference between the pressures prevailing in the two chambers deviates from the target pressure difference. As has already been explained, the target pressure difference need not be a single, concrete value, but the target pressure difference is preferably a finite pressure range.

According to a preferred embodiment, a bypass comprising a bypass valve is provided between the two chambers for executing the method according to the present disclosure. In this case, the final pressure achieved in the two chambers or the final vacuum achieved there is determined through the position of the supply air valve and thus adapted to a predetermined final vacuum, whereas the position of the controllable bypass valve is used for determining the differential pressure between the two chambers and for adapting this differential pressure e.g., to a predetermined differential pressure.

In the following, an advantageous embodiment of the disclosure will be described in more detail with reference to the below drawings.

DETAILED DESCRIPTION

Figure 1:
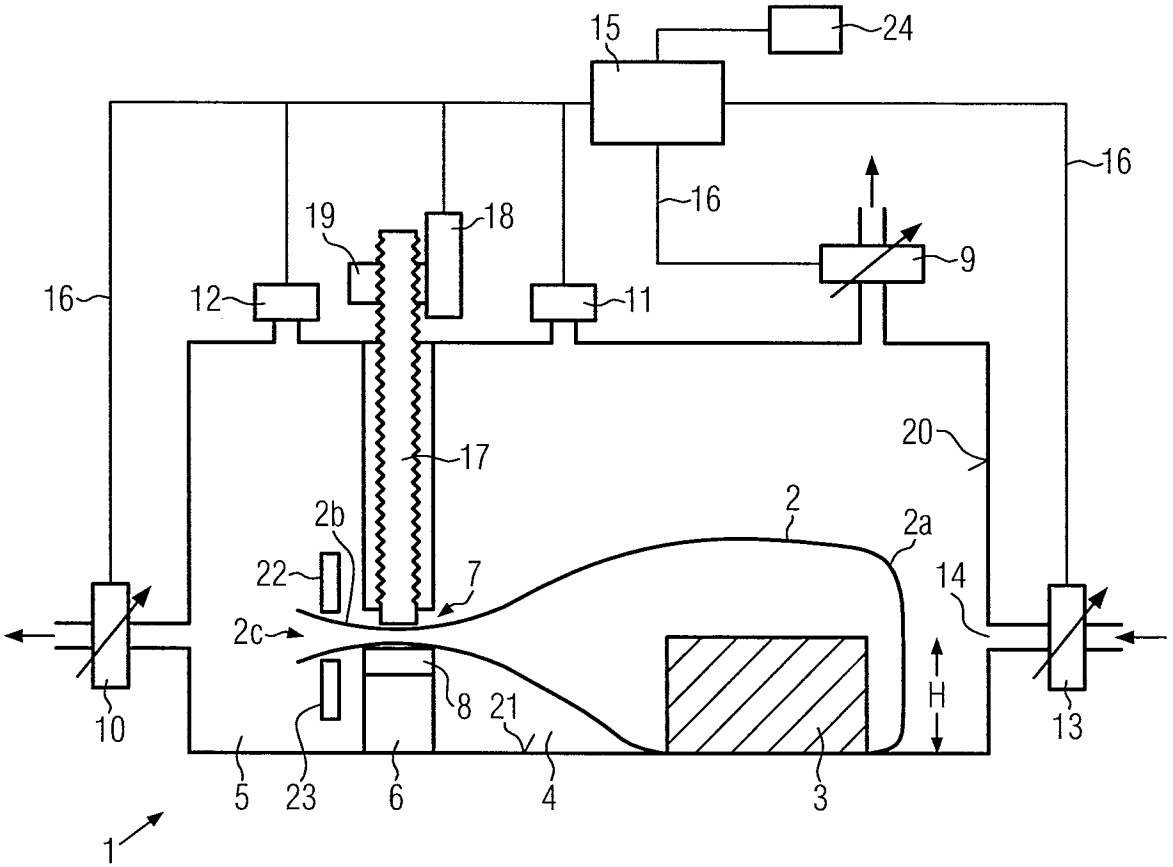
FIG. 1 is a schematic representation of an embodiment of a packaging machine according to the present disclosure.

Identical components are designated by identical reference numerals throughout the figures.

FIG. 1 shows a schematic representation of an embodiment of a packaging machine 1 according to the present disclosure. It serves to render a package 2 around a product 3 into a vacuum package through adequate evacuation and sealing. The package 2 is preferably a bag made of a sealable plastic material. The product 3 may e.g., be cheese or some other product comprising bubbles or having porous structures, which may damage the product 3 under an excessively high external vacuum.

The packaging machine 1 is provided with a first evacuable chamber 4 and a second evacuable chamber 5. The first chamber 4 is larger than the second chamber 5. The first chamber 4 is adapted to accommodate therein a product-accommodating section 2*a* of the package 2, whereas the second chamber 5 is adapted to accommodate therein an opening section 2*b* of the package 2, so that an opening 2*c* of the package 2 is freely disposed within the second chamber 5.

A partition 6, which the first chamber 4 and the second chamber 5 have in common, extends between said first and second chambers. The two chambers 4, 5 are in fluid communication with one another via a gap 7 in the partition 6, so that fluid can flow from one chamber 4 into the other chamber 5. The package 2 extends through the gap 7 from the first chamber 4 into the second chamber 5. The edges of the gap 7 may have provided thereon a sealing material 8 so as to seal the gap 7, at least in certain section thereof, against the package 2.

The first chamber 4 has provided thereon a first evacuating valve 9 through which said first chamber 4 can be evacuated. The second chamber 5 has provided thereon a second evacuating valve 10 by means of which the second chamber 5 can be evacuated. Both evacuating valves 9, 10 are connected to a common vacuum pump (not shown) and can be opened or closed independently of one another.

A first pressure gauge 11 for measuring the pressure in the first chamber 4 is provided on or in said first chamber 4. A second pressure gauge 12 is provided on or in the second chamber 5 and is used for measuring the pressure in said second chamber 5.

The packaging machine 1 is additionally provided with a supply air valve 13. This valve allows a supply of air to the first chamber 4 via a supply air opening 14. The supply air valve 13 is a control valve that can preferably be adjusted between a fully closed and a fully open position.

A control unit 15 of the packaging machine 1 is connected to the valves 9, 10, 13 and the pressure gauges 11, 12 via control and data lines 16. The measurement values of the pressure prevailing in the two chambers 4, 5, which are ascertained by means of the pressure gauges 11, 12, are transmitted to the control unit 15 via the data lines 16. The control unit is configured for ascertaining, from the values received from the two pressure gauges 11, 12, the pressure difference between the pressures prevailing in the two chambers 4, 5. In addition, it is also configured for controlling the evacuating valves 9, 10 depending on the pressure prevailing in the respective chamber 4, 5 and for controlling the supply air valve 13 depending on the difference between the pressures prevailing in the two chambers 4, 5.

An adjuster or positioning member 17 is provided so as to allow the cross-sectional area of the gap 7 to be varied and adjusted. In the present embodiment, the adjuster 17 is configured as an adjusting screw which is guided in the partition 6. An electric motor 18 located outside of the two chambers 4, 5 is provided with a drive nut 19 encompassing the adjusting screw 17. When the nut 19 is driven by the motor 18, it will raise or lower the adjusting screw 17 so as to vary the free cross-sectional area of the gap 7. Also the motor 18 is connected to the control unit 15 via a suitable control line.

The supply air opening 14, through which supply air can be conducted from the supply air valve 13 into the first chamber 4, is arranged in the wall 20 of the first chamber 4, said wall 20 being located opposite the partition 6. In particular, the supply air opening 14 is there disposed on approximately the same level H, relative to the bottom 21 of the chamber 4, as the gap 7 of the partition 6.

The packaging machine 1 additionally comprises a sealing tool comprising an upper sealing tool part 22 and a lower sealing tool part 23. The sealing tool is arranged in the second chamber 5 and is also controlled by the control unit 15. Alternatively, the sealing tool 22, 23 may also be arranged in the first chamber 4. The sealing tool parts 22, 23 are adapted to be moved towards one another so as to apply pressure and a sealing temperature and thus seal the opening area 2*b* of the package 2 in an airtight manner.

Finally, the packaging machine 1 is also provided with operator facilities 24, which can be a group of operating elements, such as buttons or the like, and/or a touch screen. By means of the operator facilities 24, an operator can input commands in the packaging machine or set specific values, in particular a target pressure difference for the pressure difference in the two chambers 4, 5 as well as the desired final pressure in one or both chambers. This target pressure difference may either be a single, concrete value or a pressure range between two values. In the latter case, the range may either be determined in that the operator determines the lower and the upper limit of this target pressure difference range. Alternatively, the operator may determine a specific value within the target pressure difference range, e.g., a medium range. The packaging machine 1 itself or the operator determines a tolerance range about this central value, e.g., a percentage deviation of 5 or 10%, plus and minus. When the actual pressure difference lies within this tolerance range about the predetermined pressure difference value, it is regarded as lying within the target pressure difference range.

The operation of the packaging machine 1 according to the present disclosure and the method according to the present disclosure take place as follows hereinbelow. Making use of the operator facilities 24, the operator inputs in the control unit 15 in the packaging machine 1 a target pressure difference value or a target pressure difference range as well as the desired final pressure in one or both chambers, e.g., 100 mbar, 150 mbar, 200 mbar or 250 mbar. Depending on the specified target pressure difference or in response to a respective input of the operator, the adjuster 17 can be moved by means of the motor 18 so as to vary the free cross-sectional area of the gap 7, if said cross-sectional area should not yet have the desired value.

The operator opens both chambers 4, 5 of the packaging machine 1 and inserts a package 2, filled with a product 3, into the packaging machine 1. This insertion can be carried out manually or automatically. After insertion of the package 2, the product-accommodating section 2*a* of the package 2 is located in the first chamber 4, whereas the opening area 2*b* of the package 2 is located in the second chamber 5. The chambers 4, 5 are closed.

As soon as the chambers 4, 5 have been closed, the control unit 15 causes the two evacuating valves 9, 10 to open. The pressure in the two chambers 4, 5 decreases. Since the volume of the second chamber 5 is smaller than that of the first chamber 4, the pressure in the second chamber 5 decreases faster than that in the first chamber 4. Since the opening 2*c* of the package 2 communicates with the second chamber 5, the lower pressure prevailing in the second chamber 5 is also applied to the interior of the package 2. This has the effect that the product-accommodating section 2*a* of the package 2 is drawn into contact with the product 3.

The pressure gauges 11, 12 monitor the pressure in each of the chambers 4, 5 continuously or at discrete intervals. The respective pressure measurement values are transmitted to the central control unit 15, which calculates the pressure difference between the two chambers 4, 5. This pressure difference increases until it reaches the tolerance range of the target pressure difference. In order to make the pressure difference arrive more quickly at this predetermined value, either the first evacuating valve 9 is opened after the second evacuating valve 10 or the supply air valve 13 is opened while the two chambers 4, 5 are being evacuated. The higher external pressure in the first chamber 4 presses the product-accommodating section 2*a* of the package 2 onto the product 3. Favored by the position of the supply air opening 14 in the wall 20 of the first chamber 4, an air current is established, preferably a laminar air current, flowing from this supply air opening 14 to the gap 7. It sweeps along the product-accommodating section 2*a* of the package 2, thus forcing the residual air contained in the package 2 to the opening 2*c* of the package 2.

When the evaluation of the measurement results of the two pressure gauges 11, 12 shows that the pressure difference approaches the tolerance range of the predetermined target pressure difference, the supply air valve 13 implemented as a control valve is slowly closed. This closing of the supply air valve 13 can take place proportionally to the velocity with which the pressure difference approaches the target pressure difference. While the pressure difference is in the tolerance range of the target pressure difference, the supply air valve 13 assumes a partially open condition. This condition is chosen such that, while the evacuating valves 9, 10 remain open, the pressure will decrease in both chambers 4, 5 at a rate which is as identical as possible, so that the pressure difference between the two chambers 4, 5 will remain in the predetermined tolerance range of the target pressure difference. If, however, the pressure difference should increase still further, the supply air valve 13 will be closed still further in accordance with the degree of deviation from the target pressure difference. Due to the continuously strong evacuation of the first chamber 4 via the evacuating valve 9, the pressure in said first chamber 4 will decrease and, consequently, also the pressure difference between the two chambers 4, 5 will decrease until it is back in the tolerance range about the target pressure difference. In other words, the control unit 15 controls the valves 9, 10, 13 such that the pressure difference between the two chambers 4, 5 will be observed as quickly as possible and as long as possible during the evacuation.

As soon as the package 2 has been evacuated to a sufficient extent, the sealing tool parts 22, 23 are closed around the opening area 2*b* of the package 2 so as to seal said opening area 2*b*. The vacuum package 2 is now finished. When the two chambers 4, 5 have been opened, it can be removed from the packaging machine 1.

Figure 2:
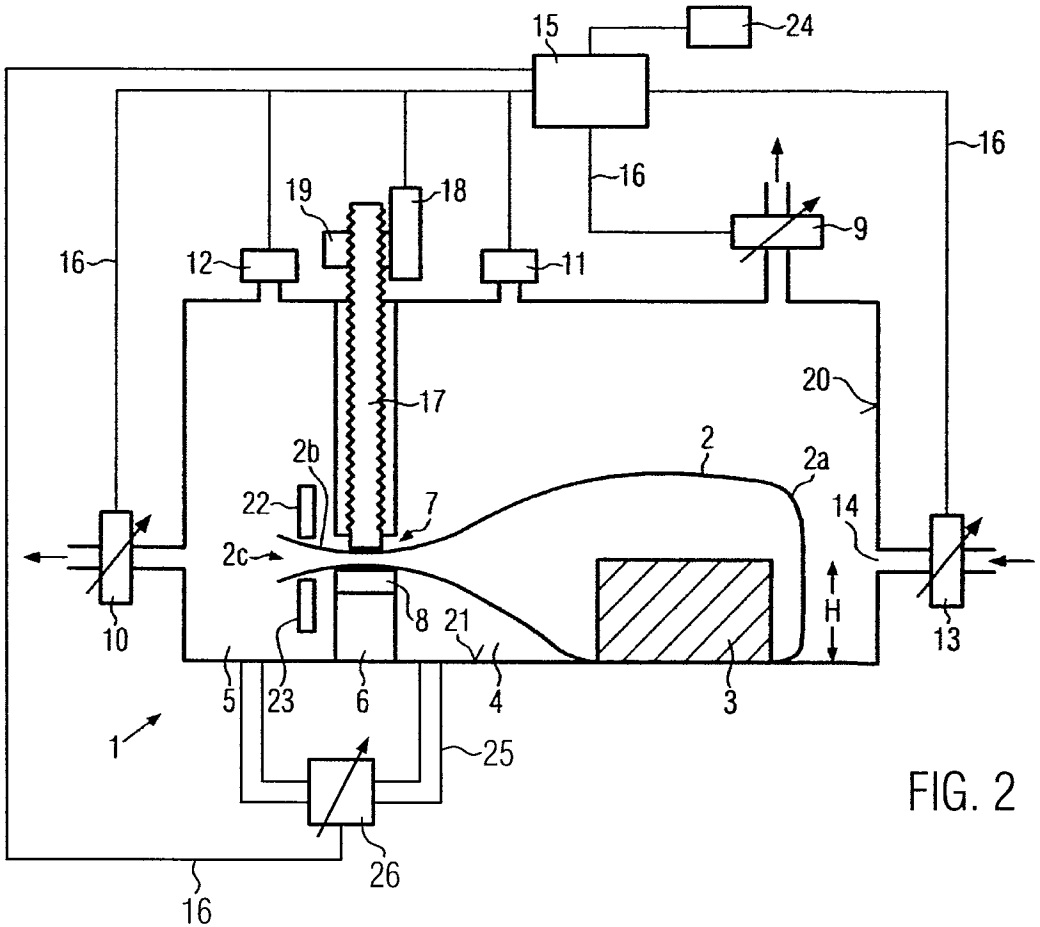
FIG. 2 is a schematic representation of a second embodiment.

FIG. 2 shows in a schematic representation a second embodiment of the packaging machine 1 according to the present disclosure. This second embodiment is largely identical with the first embodiment shown in FIG. 1. Other than the first embodiment, the packaging machine 1 according to FIG. 2 comprises, however, a bypass 25 between the two chambers 4, 5, i.e. an air duct interconnecting said two chambers 4, 5. This bypass 25 has provided therein a controllable bypass valve 26. By means of the adjustable opening area of the bypass valve 26, the rate at which air flows through the bypass 25, when there is a pressure difference in the two chambers 4, 5, can be controlled. In this way, the rate of pressure compensation between the two chambers 4, 5 can be controlled simultaneously. For controlling the bypass valve 26 in a suitable manner, also said bypass valve 26 is connected to the central control unit 15 via a control and data line 16. The provision of the bypass 25 and of the bypass valve 26 provides the advantage that pressure adaptation between the two chambers 4, 5 can take place independently of the gap 7 in the partition 6. It is thus possible to control the desired differential pressure between the two chambers 4, 5.

Figure 3:
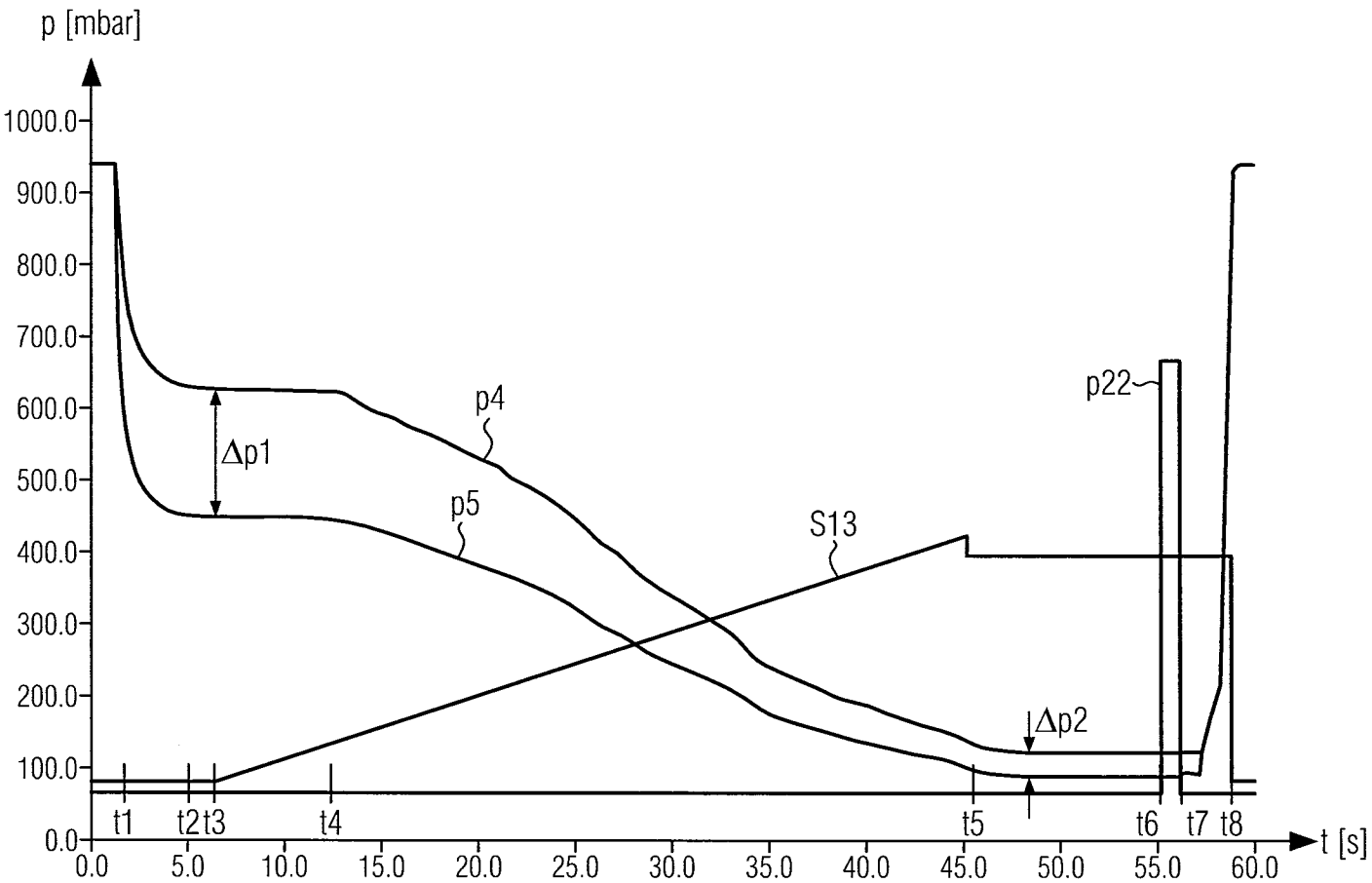
FIG. 3 is a time-pressure diagram with the profile of the pressure in the two chambers in a first situation.

FIG. 3 shows, in a time-pressure diagram, the pressure profile in the two chambers 4, 5 within one cycle of the method according to the present disclosure. In the situation shown in FIG. 3, two proportional valves are provided, viz. the supply air valve 13 and the bypass valve 26 in the bypass interconnecting the two chambers 4, 5. In FIG. 3, p4 indicates the pressure profile in the large chamber 4, p5 the pressure profile in the small chamber 5, and p22 the pressure applied by the sealing tools 22, 23. The curve S13 does not represent any pressure, but the position of the supply air valve 13; the higher the rise in curve S13 in the diagram according to FIG. 3, the smaller the opening degree of the supply air valve 13.

At the beginning of the cycle shown in FIG. 3, the pressures p4, p5 in the two chambers 4, 5 are at normal pressure until said chambers 4, 5 are closed at a moment in time t1 and evacuation of the chambers 4, 5 begins. At a moment in time t2, approximately five seconds after the beginning of the cycle, the pressures p4, p5 reach a plateau phase. In this plateau phase the pressure p4 in the larger chamber 4 exceeds the pressure p5 in the smaller chamber 5 by a differential pressure Δp1. At the moment in time t3, slow closing of the supply air valve 13 begins, which finds expression in the beginning rise in curve S13. At the moment in time t4, at approximately 12.5 seconds, the pressures p4 and p5 leave the plateau phase and decrease gradually, since from this position of the supply air valve 13 onwards the amount of air supplied is smaller than the amount of air discharged. This also has the effect that the differential pressure Δp between the pressures p4, p5 prevailing in the two chambers 4, 5 decreases.

At the moment in time t5, at approximately 45.5 seconds, the pressure p5 in the smaller chamber 5 reaches the predetermined final pressure, which is here 100 mbar. From this moment in time onwards, the supply air valve 13 is held at a constant opening width, i.e. at a constant supply air rate, and a differential pressure Δp2 between the two chambers 4, 5 is maintained. Between the moments in time t6 (at approximately 54 seconds) and t7 (and at approximately 56 seconds) the package 2 is sealed by applying a pressure p22 by means of the sealing tools 22, 23 to which a sealing pressure is applied by means of a sealing membrane (not shown). Subsequently, the chambers 4, 5 are vented and opened until normal pressure prevails once more in said chambers 4, 5 at the moment in time t8, whereupon the sealed package 2 can be removed from the packaging machine 1. A complete operating cycle has now been finished.

Figure 4:
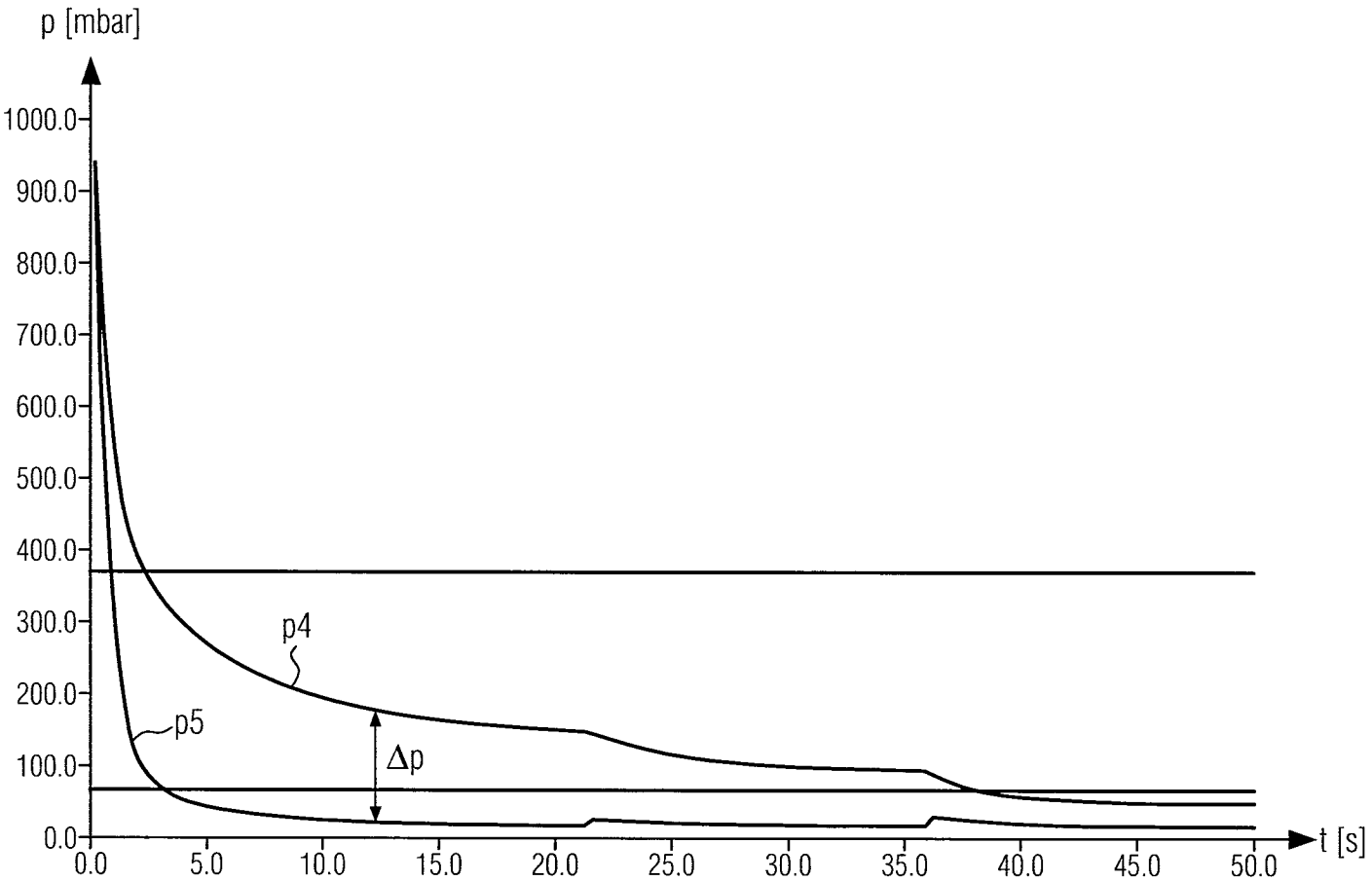
FIG. 4 is a time-pressure diagram with the profile of the pressure in the two chambers in a second situation.

FIG. 4 shows in a further time-pressure diagram how the pressures p4, p5 in the two chambers 4, 5 behave when the bypass valve 26 is gradually opened during the evacuation of the two chambers 4, 5. This opening of the bypass valve 26 causes a gradual decrease in the differential pressure Δp between the two pressures p4, p5. The comparison between FIGS. 3 and 4 shows that the position of the supply air valve 13 determines the final pressure or final vacuum obtained in the two chambers 4, 5, whereas the position of the bypass valve 26 determines the differential pressure Δp between the two chambers 4, 5.

Figure 5:
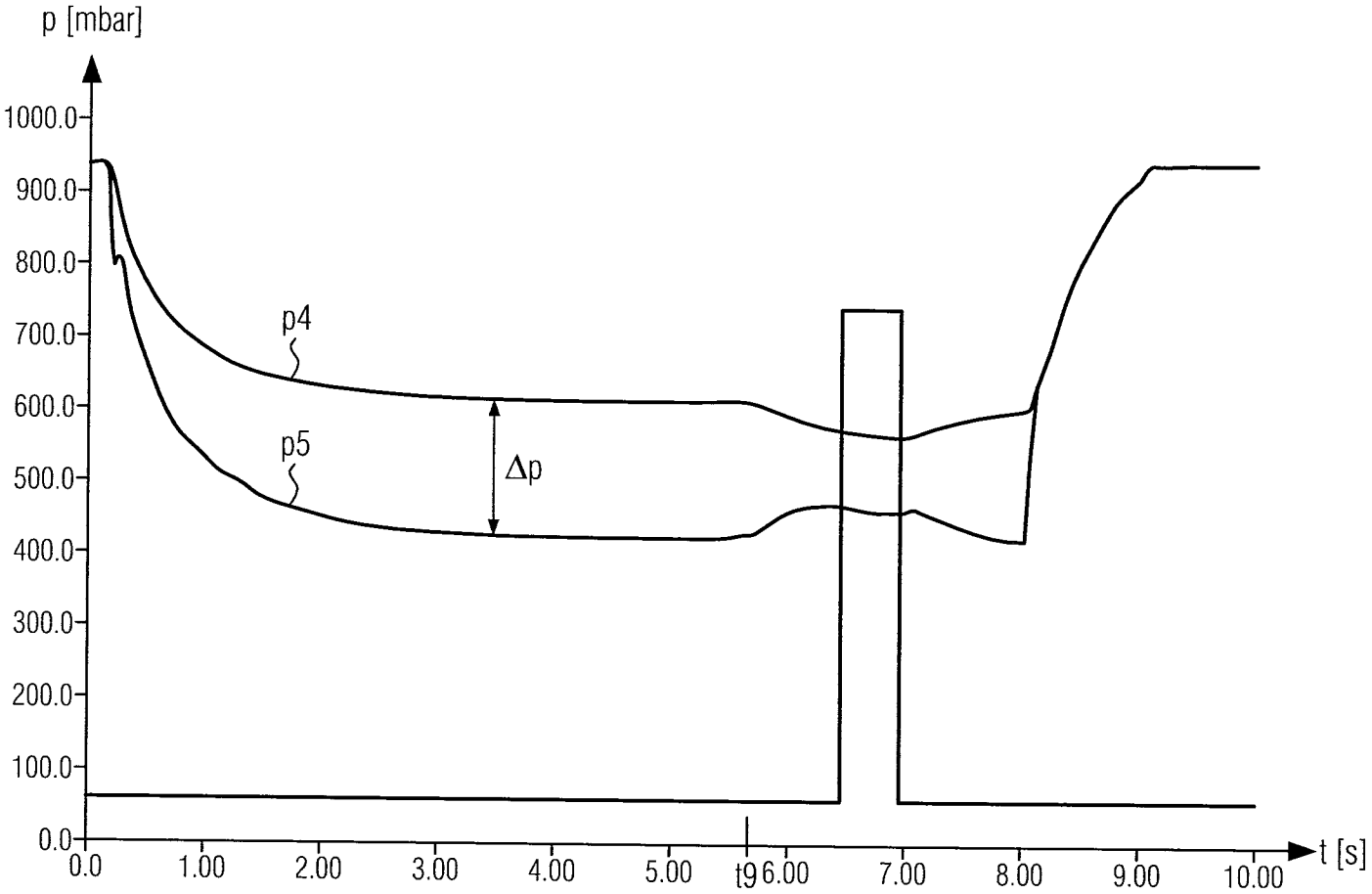
FIG. 5 is a time-pressure diagram of the profile of the pressure in the two chambers in a third situation.

FIG. 5 shows in a time-pressure diagram a problematic situation which, unless suitable precautionary measures are taken, may arise under specific exceptional circumstances when the packaging machine 1 according to the present disclosure is in operation. Also this figure shows the profiles of the pressures p4, p5 in the two chambers 4, 5, said profiles being initially similar to those shown in FIG. 3. At a moment in time t9, however, the lid of the chambers 4, 5 begins to deform under the pressure built up due to the sealing membrane. This deformation has the effect that the parts of the partition 6 suspended from the lid shift so that the opening area of the gap 7 suddenly enlarges. The consequence is that a fast pressure compensation between the two chambers 4, 5 takes place, and that the differential pressure Δp between the two chambers 4, 5 collapses from the moment in time t9 onwards, i.e. that the pressures p4 and p5 approximate one another.

Figure 6:
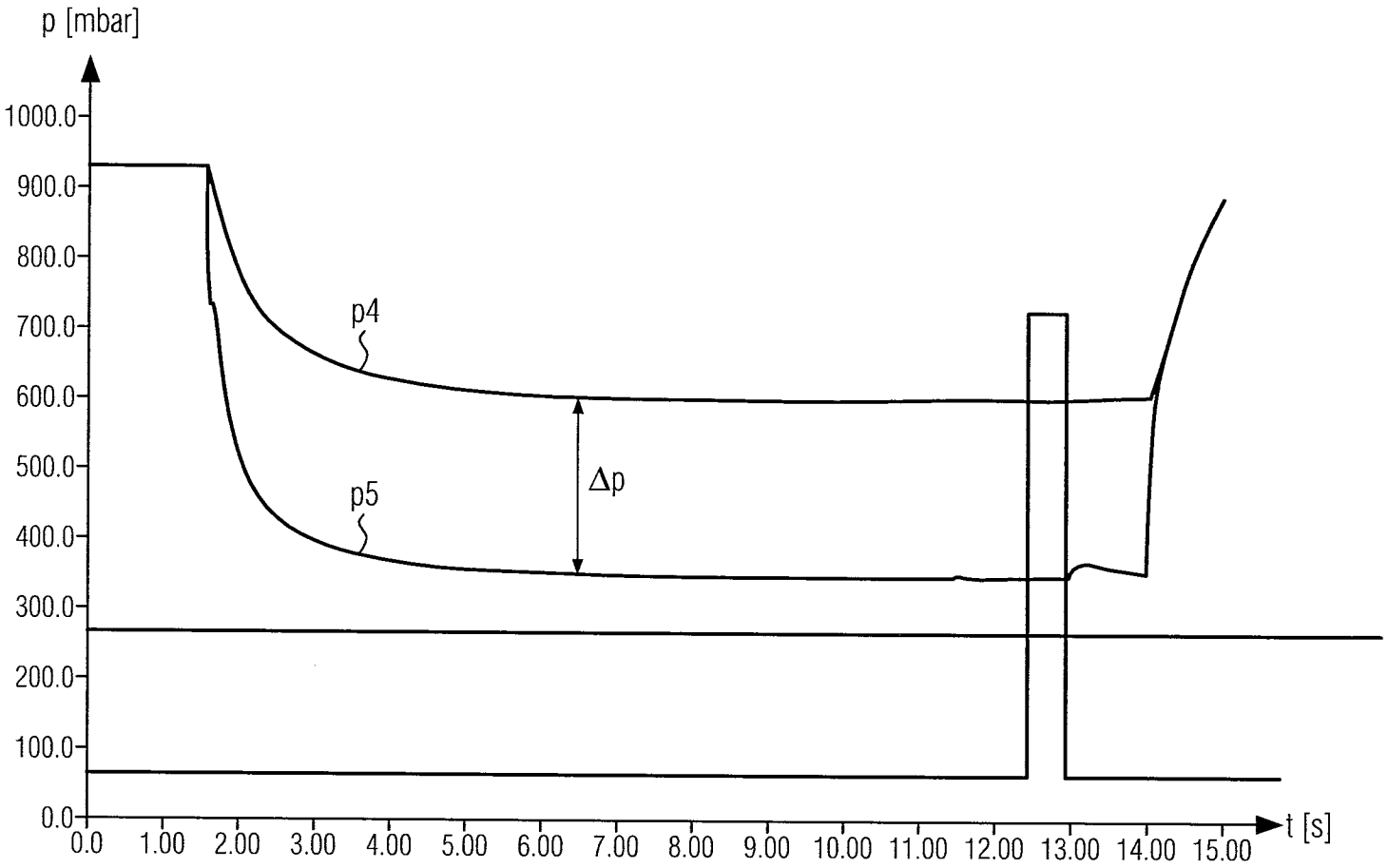
FIG. 6 is a time-pressure diagram with the profile of the pressure in the two chambers in a fourth situation.

In order to prevent this, the part of the partition 6 defining the gap can be elastically suspended (e.g., spring mounted). In this way, bending of the lid of the packaging machine 1 during sealing pressure build-up through the membrane can be compensated for, so that the cross-sectional area of the gap 7 will not change, not even if the lid should undergo deformation. The result can be seen in FIG. 6: under the same conditions as in FIG. 5, the differential pressure Δp between the two pressures p4, p5 in the two chambers 4, 5 does not collapse in FIG. 6. The gap 7 can, for example, be maintained constantly at a gap height of 0.5 mm.

While exemplary embodiments are described above, it is not intended that these embodiments describe all possible forms of the invention. Rather, the words used in the specification are words of description rather than limitation, and it is understood that various changes may be made without departing from the spirit and scope of the disclosure. Additionally, the features of various implementing embodiments may be combined to form further embodiments of the invention.

What is claimed is:

1. A packaging machine for forming a vacuum package, said packaging machine comprising:

a first evacuable chamber for accommodating therein a product-accommodating section of a package;

a second evacuable chamber for accommodating therein an opening section of the package;

a partition disposed between the first and second chambers;

a first pressure gauge for measuring a first pressure in the first chamber;

a second pressure gauge for measuring a second pressure in the second chamber; and a supply air valve for supplying air to the first chamber, wherein the supply air valve is a control valve adapted to be controlled in dependence upon a target pressure difference, the target pressure difference being one of a first desired pressure difference, or a second desired pressure difference, wherein the first desired pressure difference is between the first pressure and second pressure, and the second desired pressure difference is one of (a) a difference between the first pressure and a first predetermined target final pressure for the first chamber, or (b) a difference between the second pressure and a second predetermined target final pressure of the second chamber;

wherein an opening of the supply air valve leading into the first chamber is arranged in a wall of the first chamber located opposite the partition;

wherein the first chamber and the second chamber fluidly communicate through a gap provided in the partition; and wherein a common horizontal plane passes through both the opening of the supply air valve leading into the first chamber and the gap.

2. A packaging machine according to claim 1, wherein the supply air valve is a proportional valve.

3. A packaging machine according to claim 1, wherein the target pressure difference can be adjusted on the packaging machine.

4. A packaging machine according to claim 1, wherein an adjuster is provided for varying and adjusting the cross-sectional area of the gap.

5. A packaging machine according to claim 4, wherein at least a part of the partition is elastically mounted such that the cross-sectional area of the gap remains constant even during evacuation of the chambers.

6. A packaging machine according to claim 1, wherein the opening degree of the supply air valve is proportional to the extent to which the target pressure difference differs from one of the first pressure, the second pressure, or a difference between the first pressure and the second pressure.

7. A packaging machine for forming a vacuum package, said packaging machine comprising:

a first evacuable chamber for accommodating therein a product-accommodating section of a package;

a second evacuable chamber for accommodating therein an opening section of the package;

a first pressure gauge for measuring a first pressure in the first chamber;

a second pressure gauge for measuring a second pressure in the second chamber; and a supply air valve for supplying air to the first chamber, wherein the supply air valve is a control valve adapted to be controlled in dependence upon a target pressure difference, the target pressure difference being one of a first desired pressure difference, or a second desired pressure difference, wherein the first desired pressure difference is between the first pressure and second pressure, and the second desired pressure difference is one of (a) a difference between the first pressure and a first predetermined target final pressure for the first chamber, or (b) a difference between the second pressure and a second predetermined target final pressure of the second chamber; and wherein a bypass, in which a controllable bypass valve is arranged, is provided between the first and second chambers.

8. A packaging machine according to claim 7, wherein the opening degree of the controllable bypass valve is proportional to the extent to which the target pressure difference differs from one of the first pressure, the second pressure, or and a difference between the first pressure and the second pressure.

9. A method of forming a vacuum package, comprising:

positioning a product-accommodating section of a package in a first evacuable chamber and an opening of the package in a second evacuable chamber, evacuating said first and second chambers;

measuring the pressure in said first chamber and in said second chamber; and supplying air into said first chamber via a controllable supply air valve in dependence upon one of a first actual pressure difference between the pressure prevailing in each of the respective two chambers, and a second actual pressure difference between an actual pressure and a predetermined target final pressure for one of the first chamber and the second chamber;

further comprising controlling the second actual pressure difference through a position of the supply air valve and controlling the first actual pressure difference through a position of a controllable bypass valve provided between the two chambers.

10. A method according to claim 9, further comprising predetermining a target pressure difference for one of the first actual pressure difference or and the second actual pressure difference.

11. A method according to claim 10, further comprising opening the supply air valve inversely proportionally to the extent to which the target pressure difference differs from one of the first actual pressure difference or and the second actual pressure difference.

12. A method according to claim 9, wherein the supply air valve is partially open while both chambers are being evacuated.

* * * * *